United States Patent [19]

Shaw, III

[11] Patent Number: 4,998,496

[45] Date of Patent: Mar. 12, 1991

[54] SHROUD FOR MARINE PROPULSION SYSTEM

[76] Inventor: Herbert R. Shaw, III, 3625 Blue Gill Ct., Morris, Ill. 60450

[21] Appl. No.: 379,273

[22] Filed: Jul. 13, 1989

[51] Int. Cl.[5] ..... B63B 59/00

[52] U.S. Cl. ..... 114/222; 440/113; 150/157

[58] Field of Search ..... 114/222, 270, 361; 440/71, 113; 150/157

[56] References Cited

U.S. PATENT DOCUMENTS

| | | | |
|---|---|---|---|
| 1,100,216 | 6/1914 | Butler . | |
| 3,010,124 | 11/1961 | Dawson . | |
| 3,142,283 | 7/1964 | Fisher | 114/222 |
| 3,220,374 | 11/1965 | Sloan | 114/222 |
| 3,587,508 | 6/1971 | Pearce | 440/71 |
| 3,886,889 | 6/1975 | Burger | 114/222 |
| 4,362,437 | 12/1982 | Leary . | |
| 4,869,695 | 9/1989 | Sajdak, Jr. | 114/222 |

*Primary Examiner*—Joseph F. Peters, Jr.
*Assistant Examiner*—Jesûs D. Sotelo
*Attorney, Agent, or Firm*—Hill, Van Santen, Steadman & Simpson

[57] ABSTRACT

A shroud for a marine propulsion system includes a waterproof shroud body fastenable to the transom of a boat to surround the outboard portion of the propulsion system. Locking and sealing mechanisms secure the shroud to the boat transom in water-tight engagement and a submersible pump is operable to remove water from the shroud body so that the porpulsion system is effectively in dry dock.

16 Claims, 3 Drawing Sheets

10
58
70
14
40
66
52
50
46
48
46
V
66
44
44
50
52
V
100
99
102
68
VI
VI
19
19
42
68
68
VII
VII
96
94
92
88
90
16

40
100
104
66
102

68

42
98
92
96
68

14
99
40
68
42
110
16

40
19

SHROUD FOR MARINE PROPULSION SYSTEM

BACKGROUND OF THE INVENTION

1. Field of the Invention

The present relates generally to a shroud for a marine propulsion system which acts as a portable dry dock to remove at least portions of the marine propulsion system from the water.

2. Description of the Related Art

In marine propulsion systems, a portion of the propulsion system is submerged in the body of water in which the boat floats. It is desirable that the portions of the marine propulsion system in the water be removed from the water when the boat is not in use. Outboard motors accommodate this need by being capable of tilting to lift the propeller and other parts of the motor out of the water. It is then possible to flush the internal passageways of the outboard motor using, for example, a garden hose attachment.

An inboard marine propulsion system has only the propeller and the propeller drive shaft submerged in the water and so the problems associated with leaving the propulsion system in the water are minimized. This is particularly true since the inboard systems generally have a closed cooling system.

Inboard/outboard marine propulsion systems, on the other hand, have an outboard portion which is generally not capable of being tilted out of the water and which has bearings, gears, shafts and many other intricate internal parts. Although some inboard/outboard propulsion systems have lower, outboard units which can be tilted, it is generally not recommended that the outboard unit be left in a tilted up position since this can result in damage to the rubber bellows and seals in the unit.

Although some inboard/outboard propulsion systems have a closed cooling system which does not allow external water to circulate through the engine, even these units provide for circulation of sea water through the lower, outboard unit, the exhaust manifolds, and the heat exchanger.

The problems associated with a submerged outboard unit are particularly aggravated in salt water since rapid deterioration of the submerged lower unit can occur. In particular, electrolysis caused by dissimilar metals in the construction of the submerged unit causes decomposition as a result of electrical currents passing through the dissimilar metal parts. To overcome this problem, it has been common practice to provide sacrificial zinc anodic heads in the lower unit in various locations to minimize deterioration of the metal parts. As the anodic heads deteriorate, they must be replaced, sometimes as often as every three months when used in salt water. Salt water also causes deterioration and pitting of aluminum parts, including aluminum casings, or housings, and also causes corrosion problems with steel and cast iron components within the engine and manifolds.

A further problem with leaving the outboard portion in salt water is that salt water barnacles attach themselves to virtually any surface and can build up to a thickness of as much as two inches in a matter of weeks if not controlled. Although toxic, anti-fouling paints helps control barnacle build-up, it is not stopped entirely. Also, such anti-fouling paint is generally used only on the external surfaces of the lower unit, leaving the water intake holes and internal passageways of the unit to become clogged with barnacles, often in a few months time. Such clogged internal passageways cause impeller damage and engine overheating.

To combat the foregoing problems, it is currently the practice to remove the boat from the water when not in use so that the cooling system can be flushed and so that deterioration and barnacle build-up is prevented. The boat can either be placed on a trailer and thereby pulled from the water or the boat may be lifted from the water with a lift at a marina for placement in dry storage, or dry dock.

To remove the boat by a trailer after each use requires a considerable outlay of time, energy and money. Boat ramp fees must be paid, ramp availability must be considered as well as ramp opening and closing hours, travel time and expense in conveying the boat by trailer to the ramp locations and in loading and unloading equipment is to be considered, as well as such other factors as tide tables and the like. All of this can take the enjoyment out of a day's fishing or boating excursion.

When a marina lift is used to place the boat in the water and subsequently remove it, the business hours of the marina, which are usually from sun-up to sun-down must be considered as well as the waiting line or queue, of other boaters awaiting use of the lift. This can result in the boater being in the water and underway well after morning fishing is over, and it also requires that the day's activities be cut short in order to return to the marina before closing.

Boat owners not taking these precautions, including those whose boats which are too large to trailer or put in dry storage on a daily basis, are victims of high maintenance costs and frequent equipment failure.

The prior art includes U.S. Pat. No. 4,362,437 which discloses a device which may be attached to the hull of a ship in a liquid tight fashion so as to provide a water free volume in which work on the hull is done underwater.

A folding outboard motor cover and bracket to cover the upper portion of a motor is disclosed in U.S. Pat. No. 3,010,124.

An engine hood and slide therefor is disclosed in U.S. Pat. No. 1,100,216.

SUMMARY OF THE INVENTION

It is an object of the invention to avoid corrosion, deterioration and barnacle build-up on a lower unit of an inboard/outboard motor without removing the boat from the water.

It is another object of the present invention to keep outboard portions of a marine propulsion system dry while the boat remains in the water.

Another object of the invention is to enable a marine propulsion system to be flushed and/or rinsed with fresh water while the boat remains in salt water.

It is a further object of the invention to provide an easily attached and removed underwater shroud for a marine propulsion system.

These and other objects and advantages of the invention are achieved in a shroud for a marine propulsion system having a shroud body with water-tight walls into which at least a portion of the marine propulsion system is accepted. Also included are means for sealing the shroud body about the marine propulsion system and means for selectively fastening the shroud body in a sealing position. More particularly, the shroud body is a container preferably having a generally box-like construction with an open top and an opening in one side wall. The shroud body is of such size and shape that it surrounds the outboard portion of the marine propulsion system and keeps water from contact therewith. The opening in the sidewall accepts the lower, outboard portion and the sealing means provides a water-tight seal at the opening. The shroud body is of a water-tight material and may be constructed of fiberglass, plastic, canvas or like material. The shroud body may include a supporting frame, although this is not necessary in every instance.

As mentioned above, the sealing means seals the sidewall opening of the shroud body about the lower, outboard portion of the propulsion system. In one embodiment, the sealing means includes a pair of cooperating brackets, one of which is attached to the transom, or stern, of a boat about the lower, outboard portion and the other is attached at the opening in the sidewall of the shroud body. To ensure a water-tight seal between the brackets when cooperatively joined, it is generally necessary to use a gasket of compressible material between the brackets. One such compressible material is neoprene rubber.

The shroud body is held onto the marine propulsion system in a sealed position and is readily removable and replaceable. To accomplish this, a fastening means is provided which, in a preferred embodiment, quickly and easily permits fastening and unfastening of the shroud body in position as well as ensuring a water-tight seal between the brackets of the sealing means. One embodiment of the fastening means includes a pair of opposed engaging or locking pins, which engage the bracket attached to the shroud body. In the preferred embodiment, the engaging pins first engage the shroud bracket before the sealing means is in a fully sealed position. A further means for exerting a sealing force on the sealing means is then operated to move the shroud bracket into the sealed position.

The invention also preferably includes handle means for manipulating the shroud body when placing the shroud in position around the lower, outboard portion and when removing the shroud therefrom. It is contemplated to provide floatation means in association with the handle means, or possibly in other locations, so that the shroud unit floats.

The shroud of the present invention also includes a means for removing water from the shroud body when it is in the sealed position about the marine propulsion system. Such water removing means is in the form of a submersible pump such as a small electric bilge pump. Hand operated pumps and other water removing means are also possible, but not as convenient.

The apparatus of the present invention may be used to practice a novel method for removing water from an outboard portion of a marine propulsion system, wherein the shroud unit is first placed into the water and moved to a position surrounding the outboard portion. The shroud is then fastened in a generally water-tight engagement in this position and water is removed from the shroud. If desired, fresh water can then be placed into the shroud to rinse and flush the marine propulsion system and the fresh water then is removed from the shroud so that the propulsion system is essentially in dry dock, or dry storage, while the boat remains in the water.

To remove the shroud unit, the shroud body is filled with water and the fastening means is released so that the shroud body can be moved down and astern of the propulsion system. The shroud unit is then stowed safely away for later use.

Thus, a simple, easily operable portable dry dock is provided which achieves the objects and advantages set forth above.

DETAILED DESCRIPTION OF THE PREFERRED EMBODIMENTS

Figure 1:
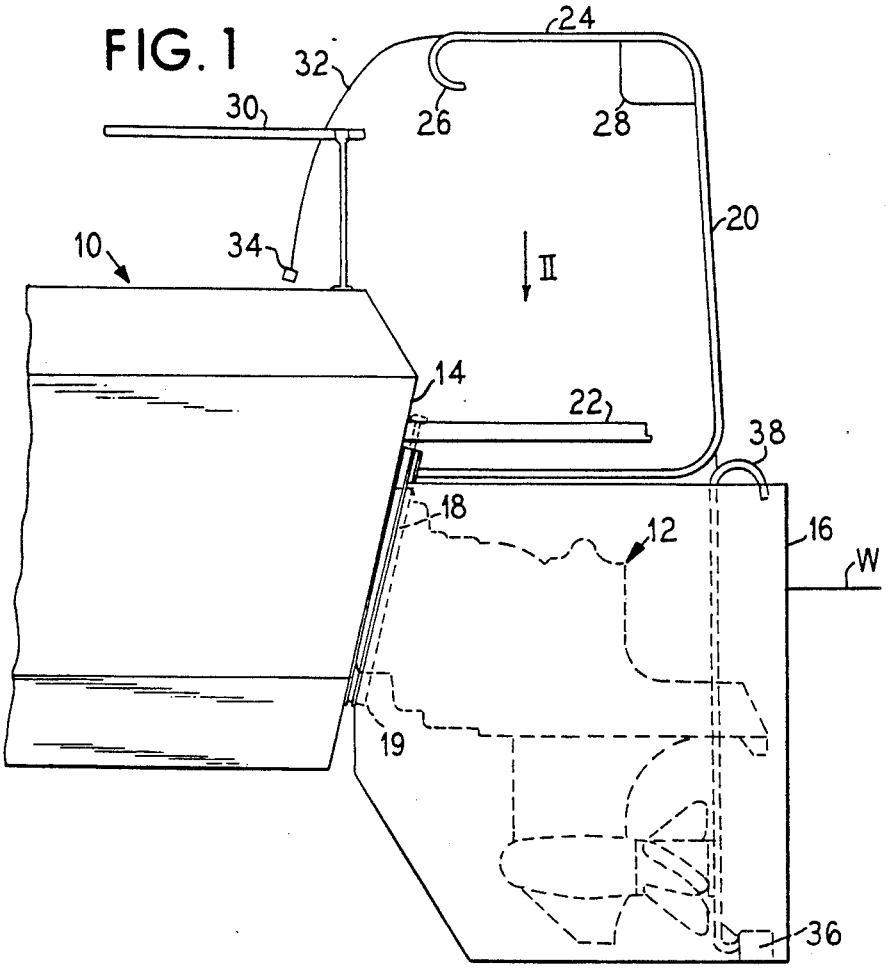
FIG. 1 is a side elevational view of the stern of a boat with an inboard/outboard drive over which the shroud unit of the present invention has been affixed.

In FIG. 1 is shown a boat 10 having an inboard/outboard marine propulsion system, an outboard portion 12 thereof being shown in dotted outline extending from a transom, or stern, 14 of the boat. Around the outboard portion 12 is a shroud body 16 mounted on the transom 14 by a sealing and mounting means 18.

Extending from the top of the shroud body 16 is a handle 20 which, as illustrated, is formed to extend around a platform 22 on the transom 14. The handle 20 is formed of a pair of vertically extending rods or tubes attached at either side of the shroud body 16 and bent to form a horizontal portion 24 having hooks 26 at the end thereof. The handles 20 extend high enough to enable the shroud body 16 to be moved beneath the outboard portion 12 from the boat 10. For stability, a cross bar 28 extends between the two handle portions 20 at the bend between the vertical portions 20 and the horizontal portions 24. The cross bar 28 of a preferred embodiment is a block of styrofoam or other floatation material which prevents the shroud unit from sinking should it be inadvertently dropped into the water. The cross bar 28 provides a convenient place for advertising, etc. The hook 26 on the end of the handle 20 permits the shroud unit to be suspended such as, for example, by being hooked onto a dock or onto hand rails 30 on the boat 10. The hooks 26 also aid in the retrieval of the shroud unit should it be dropped into the water.

Extending along the handle 20 and into the boat is an electrical lead 32 having a connector 34 at one end thereof. The electrical lead 32 is connected at its opposite end to a submersible water pump 36 mounted in the bottom of the shroud 16. A water outlet tube 38 is also connected to the submersible pump 36. The outlet tube 38 has an outlet end directed out of the shroud 16.

Figure 2:
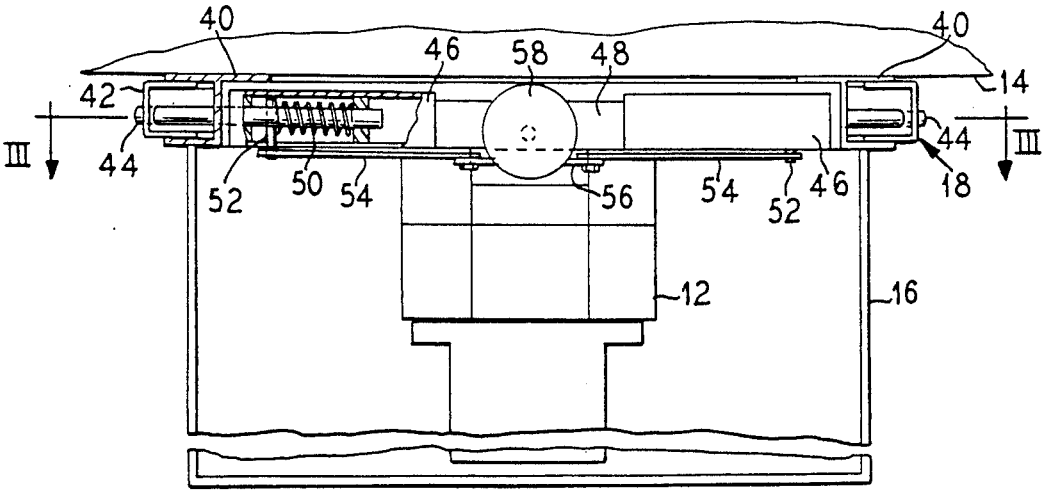
FIG. 2 is a top plan view generally in the direction of arrow II in FIG. 1 showing the fastening and sealing means for the shroud unit.

Referring now to FIG. 2, the shroud body 16 is shown and through its open top can be seen the outboard portion 12. The shroud body 16 is affixed to the transom 14 of the boat by the sealing and fastening means 18 which includes a transom bracket 40 and a shroud bracket 42 for engaging the transom bracket 40. The two brackets 40 and 42 are held together by a pair of engaging pins, or locking rods, 44 which are slidably mounted in locking tubes 46 connected at opposite ends of a central locking bracket 48. In FIG. 2, the left hand side locking tube is partially cut away to reveal the engaging pin 44 encircled by a return spring 50 and from which extends a transverse stop pin 52. The stop pin 52 extends through a slot in the side of the locking tube 46 and is pivotally attached to a release arm 54. At the opposite ends of the release arms 54 is a second pair of release arms 56, as will be described in greater detail hereinafter. An adjusting knob 58 by which the entire locking assembly can be moved vertically is also shown.

Figure 3:
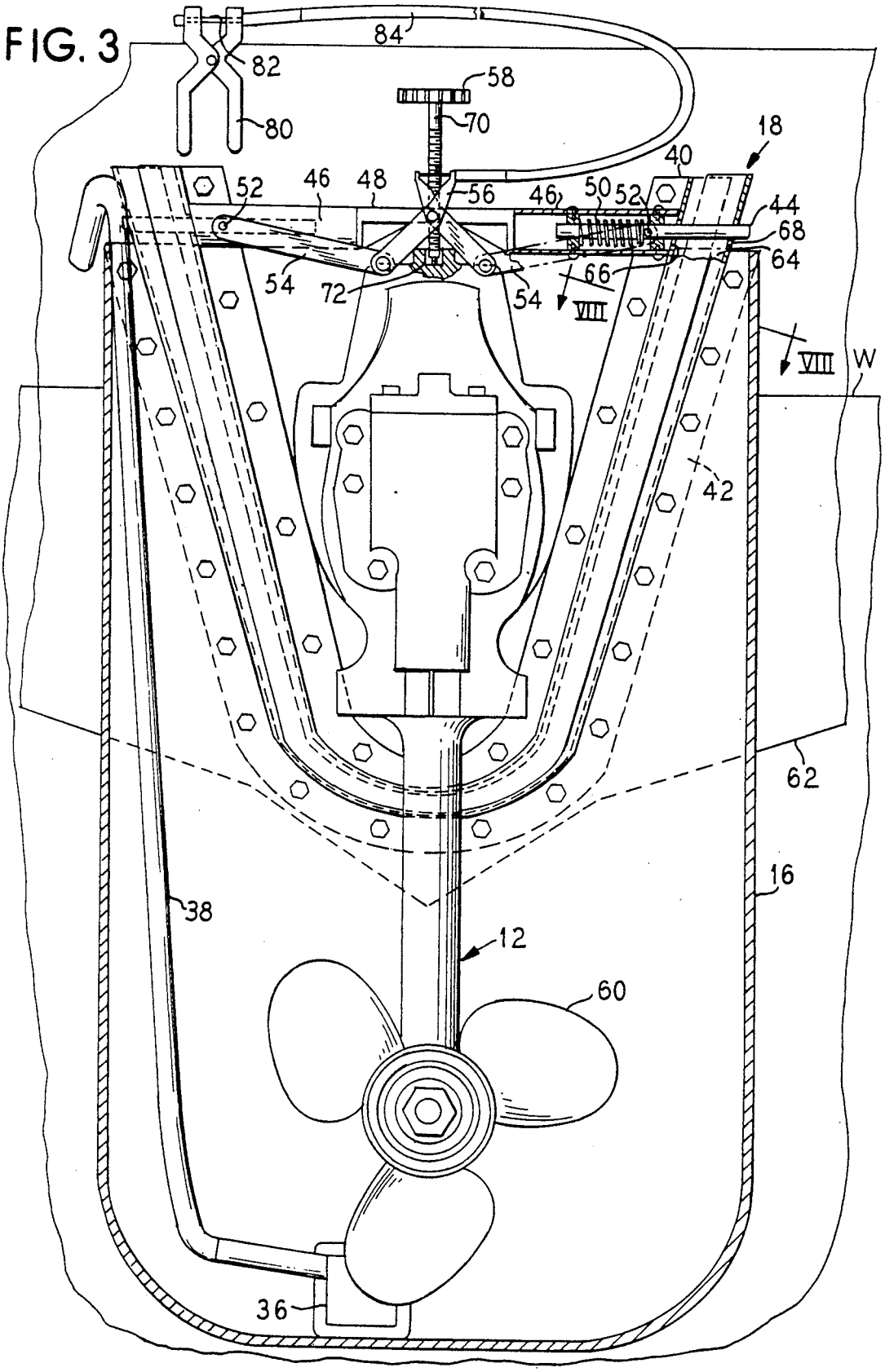
FIG. 3 is a cross section along line III—III showing the mounting and fastening hardware for the present shroud unit.

In FIG. 3 is shown in somewhat more detail the fastening and sealing means of the present invention. The shroud 16 encloses the outboard portion 12 and provides sufficient room for a propeller 60 to turn within the shroud 16. The submersible pump 36 is located so that it is clear of the propeller 60 as well. The propeller 60 extends below the hull line 62 of the boat. The body of the outboard portion 12 is generally below the water line W. Therefore, the shroud 16 must be deep enough to accommodate the propeller yet have high enough wall to extend above the water line W, preferably being high enough so that few waves splash into the shroud.

As can be seen, the transom bracket 40 is bolted onto the transom of the boat, while the shroud bracket 42 is bolted onto the shroud 16. A clearance may be made in the transom bracket for the boat drain plug (not shown). The brackets 40 and 42 have a generally U-shaped configuration and fit cooperatively together about the outboard portion 12 where it passes through the transom of the boat. Between the two brackets 40 and 42 is mounted a compressible gasket 64, which will be described in greater detail hereinafter. As can be seen, the arms of the U-shaped brackets angle outwardly to enable the gasket to be compressed by vertical movement.

The engaging pins, or locking rods 44, hold the brackets 40 and 42 together by extending through openings 66 in the transom bracket 40 and openings 68 in the shroud bracket 42. While the openings 68 are generally slightly larger than the size of the engaging pins 44, the openings 66 in the transom bracket 40 are elongated slots. The slots 66 enable the pins 44 to move vertically relative to the transom bracket 40 to pull the shroud bracket 42 into sealing engagement with the transom bracket 40.

This is accomplished by rotation of the adjusting knob 58 attached to an adjusting screw 70 which extends through a threaded bore in the locking bracket 48. The adjusting screw 70 is freely rotatable in a pivot 72 mounted in the top of the outboard portion housing. The locking tubes 46 are affixed to the opposite ends of the locking bracket 48 by welding or are formed in one piece and are freely slidable relative to the transom bracket 40 so that rotation of the adjusting knob 58 threadably moves the locking bracket 48 vertically on the adjusting screw 70. This, in turn, moves the engaging pins 44 vertically to pull the shroud bracket 42 upwardly into sealing engagement.

To release the shroud 16 from the boat, a caliper 80 much like a bicycle brake lever is operated to pull a cable 82 relative to a cable housing 84 which is connected at its opposite end to the release arms 56. As the release arms 56 are pivoted toward one another, the release arms 54 are drawn inwardly, thereby sliding the engaging pins 44 axially until the end of each engaging pin 44 passes through the opening 68 in the shroud bracket 42. The shroud is then free of the boat and can be removed by manipulation of the shroud handles 20. It may be necessary to loosen the adjusting screw 70 to relieve the pressure on the engaging pins 44 by the shroud bracket 42 before the caliper 80 can be manipulated.

To install the shroud 16 on the boat 10, the handles 20 are manipulated to move the shroud body under and around the outboard portion 12. As the shroud bracket 42 moves into engagement with the transom bracket 40, the outermost ends of the engaging pins 44, which are preferably rounded off or beveled, slide along the interior of the shroud bracket until they click into engagement through the holes 68. The adjusting knob 58 is then rotated to draw the engaging pins 44 upwardly and seal the shroud bracket 42 against the transom bracket 40.

Figures 4, 5, 6, 7, 8, 9:
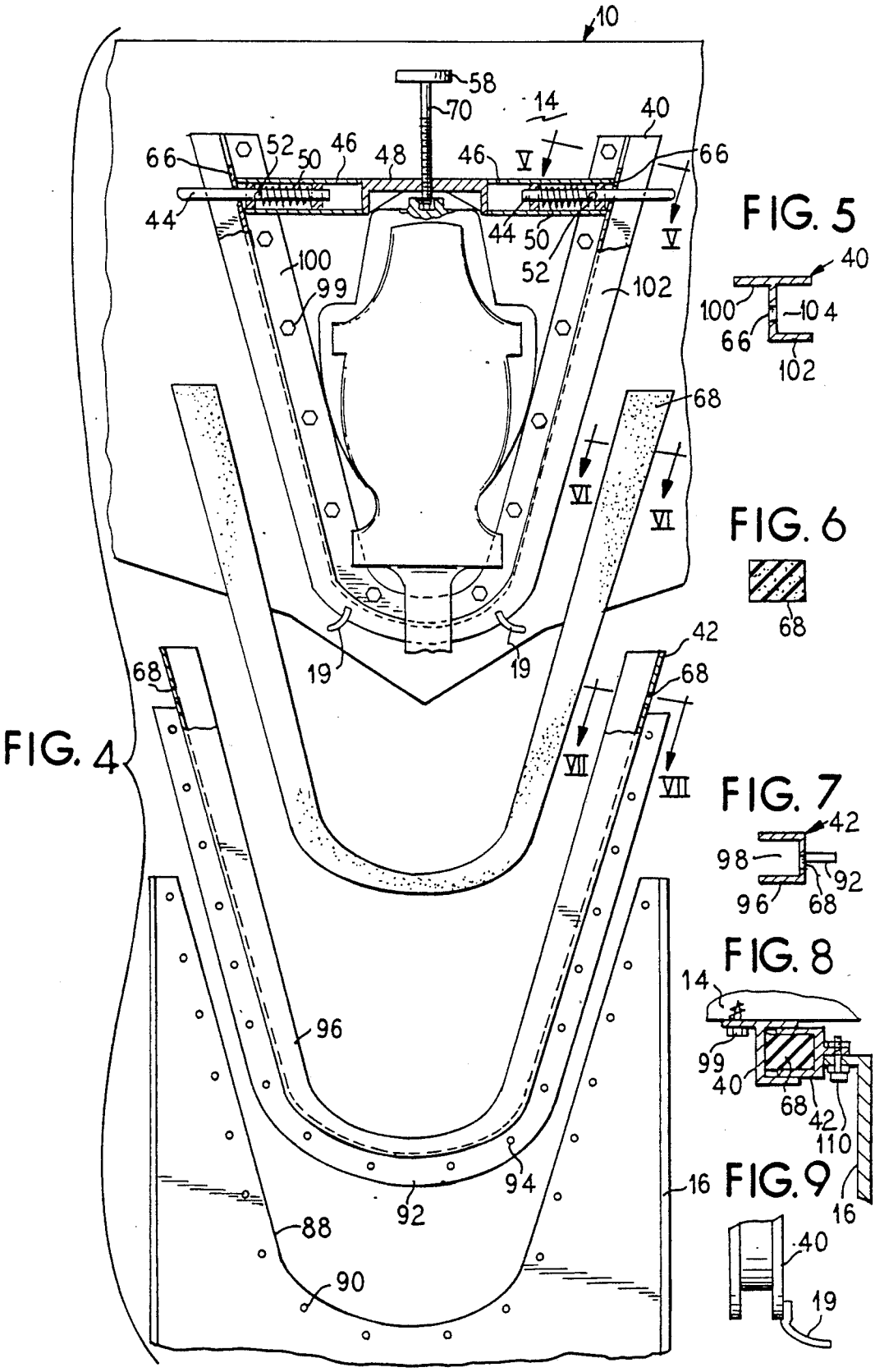
FIG. 4 is an exploded view of the mounting and fastening hardware of the invention.
FIG. 5 is a cross section along line V—V in FIG. 4 of the transom bracket.
FIG. 6 is a cross section along line VI—VI in FIG. 4 of a sealing gasket.
FIG. 7 is a cross section along line VII—VII in FIG. 4 of the shroud bracket.
FIG. 8 is a cross section along line VIII—VIII in FIG. 3 of the brackets in a sealing engagement.
FIG. 9 is a side view of a lower portion of the transom bracket of FIG. 4 showing the guiding arms.

FIG. 4 shows the various parts of the fastening and sealing means. In particular, the shroud body 16 has a generally U-shaped opening 88 in one side wall. Bolt holes 90 are spaced equally about the opening 88. The shroud bracket 42 is the same shape as the opening 88 and which includes a bolt flange 92 having a plurality of bolt holes 94 for placement in registration with the holes 90. Also forming part of the shroud bracket 42 is a channel 96 defining an inwardly facing gasket trough 98, as can be seen in more detail in FIG. 7.

Above the shroud bracket 42 in FIG. 4 is shown the gasket 68 of compressible material, such as neoprene rubber. The gasket 68 is shaped to lie within the gasket trough 98 of the shroud bracket 42. FIG. 6 shows a cross section of the gasket 68.

Referring back to FIG. 4 again, the transom bracket 40 is bolted onto the transom 14 of the boat by bolts 99 passing through a bolt flange 100. Outwardly of the bolt flange 100 is a channel 102 having an interior space 104 for accepting the shroud bracket 42. The configuration of the transom bracket 40 is also shown in FIG. 5.

FIG. 8 shows the transom bracket 40 and shroud bracket 42 in sealing engagement with the gasket 68 compressed in the respective channels. The transom bracket 40 is bolted to the transom 14 by bolts 99 while the shroud bracket 42 is bolted to the shroud 16 by bolts 110. Preferably, washers, backing flanges or other load distributing means are provided at the connection between the shroud 16 and the shroud bracket 42, since as much as 300 to 400 pounds of floatation force may be exerted on the shroud. To ensure a water-tight seal, an additional rubber gasket, industrial glue or other caulking or sealing means is provided at the connections, seams and joins of the brackets, the shroud, and the transom.

FIG. 9 shows guiding arms 19 which help to guide the shroud bracket 42 to line up with the transom bracket 40.

In a preferred embodiment, the shroud is a seamless box-like structure of fiberglass, although canvas, plastic or other materials both with and without supporting frames can be substituted. The shroud bracket and the transom bracket may be made either of stainless steel or fiberglass. Stainless steel generally is used throughout for the parts of the fastening mechanism to resist corrosion. The rubber gasket 68 in a preferred embodiment is of ANSI 34 rubber material.

To attach the shroud unit to a boat, first the ignition is turned off and the outboard portion is placed in the full down position with the steering wheel straight. The shroud body is submerged and by grasping the handles is brought under the outboard portion and lifted up to the transom bracket guided by guiding arms 19, sliding upwardly until the engaging pins click into the openings 68 in the shroud bracket.

The adjusting knob is then turned to squeeze the gasket 68 between the brackets 40 and 42 and thereby effect a liquid tight seal. The connector 34 for the submersible pump is plugged in and the submersible pump turned on to pump sea water out of the shroud body. After the sea water is removed, the shroud is filled with fresh water, such as from a dock hose. With the gear shift of the boat in neutral, the engine is started and left to idle for a few minutes while other equipment is being stowed. Finally, the engine is stopped and the fresh water is pumped out leaving a clean, dry outboard portion of the marine propulsion system without removal of the boat from the water.

Removal of the shroud unit is accomplished by filling the shroud with water either from a dock hose or by a sealable water inlet which may formed in the shroud. The adjusting knob 58 is loosened, and the release caliper 80 is operated to retract the engaging pins 44. By grasping the handles 20, the shroud body 16 is then moved down and astern of the outboard portion and the pump 36 may now be turned on to remove water and allow the shroud to be lifted from the water. The connector for the submersible pump is disconnected and the boat is ready to go.

Thus, there is disclosed and shown an underwater shroud for a marine propulsion system which operates as a portable dry dock to protection outboard portions of the propulsion system from corrosion and barnacle build-up.

Although other modifications and changes may be suggested by those skilled in the art, it is the intention of the inventor to embody within the patent warranted hereon all changes and modifications as reasonably and properly come within the scope of his contribution to the art.

I claim:

1. A shroud for an outboard portion extending from a transom of a boat of an inboard/outboard marine propulsion system mounted in the boat, comprising:

a shroud body having water-tight walls and an opening for accepting an outboard portion of an inboard/outboard propulsion system;

means for sealing said opening of said shroud body on the transom of the boat about the outboard portion when in a sealing position, said means for sealing comprises a sealing channel spaced from the transom when in the sealing position; and means for selectively fastening said shroud body in said sealing position.

2. A shroud as claimed in claim 1, wherein said means for sealing includes a first bracket affixed to said shroud body at said opening and a second bracket defining said sealing channel and mounted on the transom of the boat about the outboard portion of the inboard/outboard propulsion system, said first and second brackets being cooperatively engagable in a sealing relationship along said sealing channel.

3. A shroud as claimed in claim 2, wherein said means for sealing includes a gasket fastenable between said first and second brackets in said sealing channel, said gasket being isolated from the transom of the boat when in a sealing position.

4. A shroud as claimed in claim 1, further comprising: means for removing liquid from said shroud body when in said sealing position.

5. A shroud as claimed in claim 1, wherein said means for selectively fastening includes means for moving said shroud-body only in a direction substantially parallel to the transom of the boat from a non-sealing position to said sealing position.

6. A shroud as claimed in claim 1, further comprising: a handle extending from said shroud body to a position engagable by a person in a boat to which said shroud body is fastened in said sealing position.

7. A shroud as claimed in claim 1, further comprising: a float affixed to said shroud body.

8. A shroud as claimed in claim 1, wherein said shroud body is open toward the top and is closed water-tight toward the bottom and at least three lateral sides so that water is prevented from entering said shroud body when in said sealing position on a boat floating on the water.

9. A shroud for an outboard portion of an inboard/-outboard marine propulsion system, comprising:

a shroud body having water-tight walls and an opening for accepting an outboard portion of an inboard/outboard propulsion system;

means for sealing said opening of said shroud body about the outboard portion when in a sealing position; and means for selectively fastening said shroud body in said sealing position, said means for selectively fastening includes means for moving said shroud-body from a non-sealing position to said sealing position, said means for moving includes a vertically oriented threaded bolt extending through a threaded bore and operable to produce relative movement between said shroud body and said marine propulsion system.

10. A shroud for an outboard portion of an inboard/-outboard marine propulsion system, comprising:

a shroud body having water-tight walls and an opening for accepting an outboard portion of an inboard/outboard propulsion system;

means for sealing said opening of said shroud body about the outboard portion when in a sealing position, said means for sealing including a generally U-shaped bracket having first and second engagement openings in opposite legs of said U-shaped bracket, said U-shaped bracket being located at said opening of said shroud body for positioning about the outboard marine propulsion system; and means for selectively fastening said shroud body in said sealing position, said means for selectively fastening including first and second engagement pins movable into an engagement position extending through respective ones of said first and second engagement openings.

11. A shroud as claimed in claim 10, further comprising:

springs mounted to bias said first and second engagement pins toward said engagement position; and means for selectively moving said first and second engagement pins into and out of said engagement position.

12. A method for removing an outboard portion of an inboard/outboard marine propulsion system from the water, comprising the steps of:

placing a shroud into the water and about the outboard portion;

fastening said shroud in sealing engagement about the outboard portion by exerting a force on said shroud substantially parallel to a transom of a boat to form a seal spaced from the transom of the boat; and removing water from said shroud.

13. A method as claimed in claim 12, further comprising the steps of:

after said step of removing water, putting fresh water in said shroud to flush the marine propulsion system; and removing said fresh water from said shroud.

14. A method as claimed in claim 12, wherein said step of removing includes pumping water from said shroud.

15. A method for removing an outboard portion of an inboard/outboard marine propulsion system from the water, comprising the steps of:

placing a shroud into the water and about the outboard portion;

fastening said shroud in sealing engagement about the outboard portion, said step of fastening includes moving engaging pins into an engaging position to connect said shroud and said marine propulsion system, and applying a force to said engaging pins to move said shroud into a water-tight sealing engagement about said marine propulsion system; and removing water from said shroud.

16. A portable dry-dock for a marine propulsion system, comprising:

a first bracket of a generally U-shape adapted to fasten about the marine propulsion system with guiding arms for the purpose of alignment;

a second bracket of a generally U-shape, said second bracket being shaped for cooperative engagement with said first bracket;

a gasket of deformable material mounted between said first and second brackets when in cooperative engagement to form a substantially liquid-tight seal;

a shroud body affixed to said second bracket, said shroud body having a liquid-tight wall portion of such dimensions as to extend about a portion of said marine propulsion system;

a pump mounted to remove water from said shroud body;

a locking bracket mounted for vertical movement relative to said first bracket, said locking bracket having first and second axially slidable pins extending through opening in said first bracket, said first and second pins being selectively engagabled into openings in said second bracket when said second bracket is in cooperative engagement with said first bracket;

means for moving said locking bracket vertically relative to said first bracket so that said first and second pins pull said second bracket into water-tight engagement with said first bracket; and means for selectively moving said first and second pins to a position free of said openings in said second bracket.

* * * * *